US006782221B2

(12) United States Patent
Saito et al.

(10) Patent No.: US 6,782,221 B2
(45) Date of Patent: Aug. 24, 2004

(54) IMAGE FORMING APPARATUS HAVING TWO DEVELOPER STORAGE UNITS, PROCESS CARTRIDGE HAVING TWO DEVELOPER STORAGE UNITS, AND RECYCLING METHOD THEREOF

(75) Inventors: Manabu Saito, Saitama (JP); Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/366,460

(22) Filed: Feb. 14, 2003

(65) Prior Publication Data

US 2004/0047648 A1 Mar. 11, 2004

(30) Foreign Application Priority Data

Sep. 6, 2002 (JP) ..... P2002-261909

(51) Int. Cl.[7] ..... G03G 15/00
(52) U.S. Cl. ..... 399/109; 399/111; 399/120
(58) Field of Search ..... 399/109, 110, 399/111, 120, 360

(56) References Cited

U.S. PATENT DOCUMENTS 5,426,493 A * 6/1995 Oyler ..... 399/110

FOREIGN PATENT DOCUMENTS

| | | |
|---|---|---|
| JP | 6-1245 B2 | 2/1994 |
| JP | 10-207160 | 8/1998 |

* cited by examiner

*Primary Examiner*—Quana Grainger
(74) *Attorney, Agent, or Firm*—Morgan, Lewis & Bockius LLP

(57) ABSTRACT

A first developer storage unit 116*a* is provided under a horizontal line which is extended from a latent image writing position "P" where a latent image is written in an image carrier 44, and a developer-storing housing unit 70 is provided above the horizontal line extended from the latent image writing position of the image carrier. Since a stirring/transporting member is rotatably supported in a stirring/transporting member hole 115*a* which is formed in this developer-storing housing unit 70, a second developer storage unit is constructed.

20 Claims, 17 Drawing Sheets

IMAGE FORMING APPARATUS HAVING TWO DEVELOPER STORAGE UNITS, PROCESS CARTRIDGE HAVING TWO DEVELOPER STORAGE UNITS, AND RECYCLING METHOD THEREOF

BACKGROUND OF THE INVENTION

1. Field of the Invention

The present invention is related to an electrophotographic type image forming apparatus, and also related to a process cartridge employed in this image forming apparatus, and a recycling method thereof.

2. Description of the Related Art

As this sort of image forming apparatus, such an image forming apparatus is known in which while a recording medium is transported along a substantially vertical direction, an image is formed on this transported recording medium, and then, the recording medium on which the image has been formed is ejected to an ejection unit provided on an upper portion of a main body of this image forming apparatus as disclosed in JP-A-10-207160. Also, as a process cartridge employed in this sort of image forming apparatus, such a compact process cartridge has been realized by positioning a developing portion, an exposing portion, and a cleaning portion on the same side with respect to a vertical plane which intersects a rotation center of an image carrier as disclosed in JP-B-6-12475.

However, since the developer storage unit is arranged under the exposing unit in the conventional known image forming apparatus, in such a case that the storage capacity of the developer storage unit is wanted to be increased, increasing of this storage capacity of the developer storage unit may easily give an adverse influence to, for example, the position of the paper supply unit and the position of the optical writing apparatus, which are arranged under the conventional image forming apparatus. The technical specifications are variously changed in connection with changes in the developer storage capacities. Thus, there are such problems that the structural components of the conventional image forming apparatus can be hardly and commonly used, and furthermore, the entire dimension of the image forming apparatus is increased when the storage capacity of the developer storage unit is increased.

SUMMARY OF THE INVENTION

An object of the present invention is to solve the conventional problems, and therefore, to provide an image forming apparatus and a process cartridge, which can minimize changes in other structural components even when a developer storage capacity is changed, and also can be made compact.

To achieve an object, a first feature of the present invention is such an image forming apparatus includes an image forming section having an image carrier, and an ejection unit from which a recording medium where an image has been formed by the image forming section is ejected, in which a first developer storage unit is provided under a horizontal line which is extended from a latent image writing position of the image carrier where a latent image is written along a substantially horizontal direction, and a developer-storing space for arranging a second developer storage unit is provided above the horizontal line extended from the latent image writing position of the image carrier and between the horizontal line and the ejection unit. As a consequence, since the developer storage unit space used to arrange the second developer storage unit is provided at a lower portion of the ejection unit which may readily produce a dead space, the storage capacity of the developer storage unit can be easily increased, and moreover, the image forming apparatus is not made bulky.

A second feature of the present invention is such an image forming apparatus includes an image forming section having an image carrier, and an ejection unit from which a recording medium where an image has been formed by the image forming section is ejected, in which a first developer storage unit is provided under a horizontal line which is extended from a latent image writing position of the image carrier where a latent image is written along a substantially horizontal direction, and a developer-storing housing unit for forming a second developer storage unit is provided above the horizontal line extended from the latent image writing position of the image carrier and between the horizontal line and the ejection unit. As a consequence, in such a case that the developer storage capacity of the first developer storage unit can be satisfied, only the developer-storing housing unit is left without constructing of the second developer storage unit. In such a case that the developer storage capacity is wanted to be increased due to a post specification change, the second developer storage unit may be arranged by mounting the necessary structural components such as the stirring/transporting members on the developer-storing housing unit. In this case, a stirring/transporting member hole for stirring/transporting a stirring/transporting member which stirs/transports the developer stored in the second developer storage unit may be previously and preferably formed in the developer-storing housing unit.

A third feature of the present invention is such an image forming apparatus includes an image forming section having an image carrier, and an ejection unit from which a recording medium where an image has been formed by the image forming section is ejected, in which the image forming section includes a first developer storage unit provided under a horizontal line which is extended from a latent image writing position of the image carrier where a latent image is written along a substantially horizontal direction, and a second developer storage unit provided above the horizontal line extended from the latent image writing position of the image carrier and between the horizontal line and the ejection unit, and the second developer storage unit is detachably mounted. As a result, in the case that the developer storage capacity of the first developer storage unit can be satisfied, the second developer storage unit may be merely dismounted. In such a case that the developer storage capacity is wanted to be increased due to a post specification change, the second developer storage unit may be mounted.

In this case, preferably, the developer storage capacity of the second developer storage unit is made larger than that of the first developer storage unit. Since the second developer storage unit is arranged at a lower portion of the ejection unit which may readily constitute a dead space, this dead space portion can be effectively utilized.

Also, the image forming section may preferably include the image carrier, the first developer storage unit, and the second developer, and may be preferably comprised of a process cartridge having a developing unit for developing a latent image of the image carrier so as to produce a visible image.

Also, while the process cartridge includes storage section for storing such a fact as to whether or not the second developer storage unit is present, a history of the process cartridge may be preferably left in this storage section.

The process cartridge may includes a first cartridge unit in which the first developer storage unit is provided, and a second cartridge unit in which the second developer storage unit is provided, and a second cartridge unit in which the second developer storage unit is provided, and the second cartridge unit may be detachably provided with respect to the first cartridge unit. Alternatively, the process cartridge may includes a first cartridge unit in which the first developer storage unit is provided, a second cartridge unit in which the second developer storage unit is provided, and a third cartridge unit in which the image carrier is provided, and the first cartridge unit, the second cartridge unit, and the third cartridge unit may be detachably mounted with respect to the respective cartridge units.

Furthermore, the present invention may cover a process cartridge employed in the image forming apparatus, and also, may cover both a method for recycling this process cartridge, and a method for manufacturing this process cartridge.

DETAILED DESCRIPTION OF THE PREFERRED EMBODIMENTS

Referring now to drawings, embodiment modes of the present invention will be described.

Figure 1:
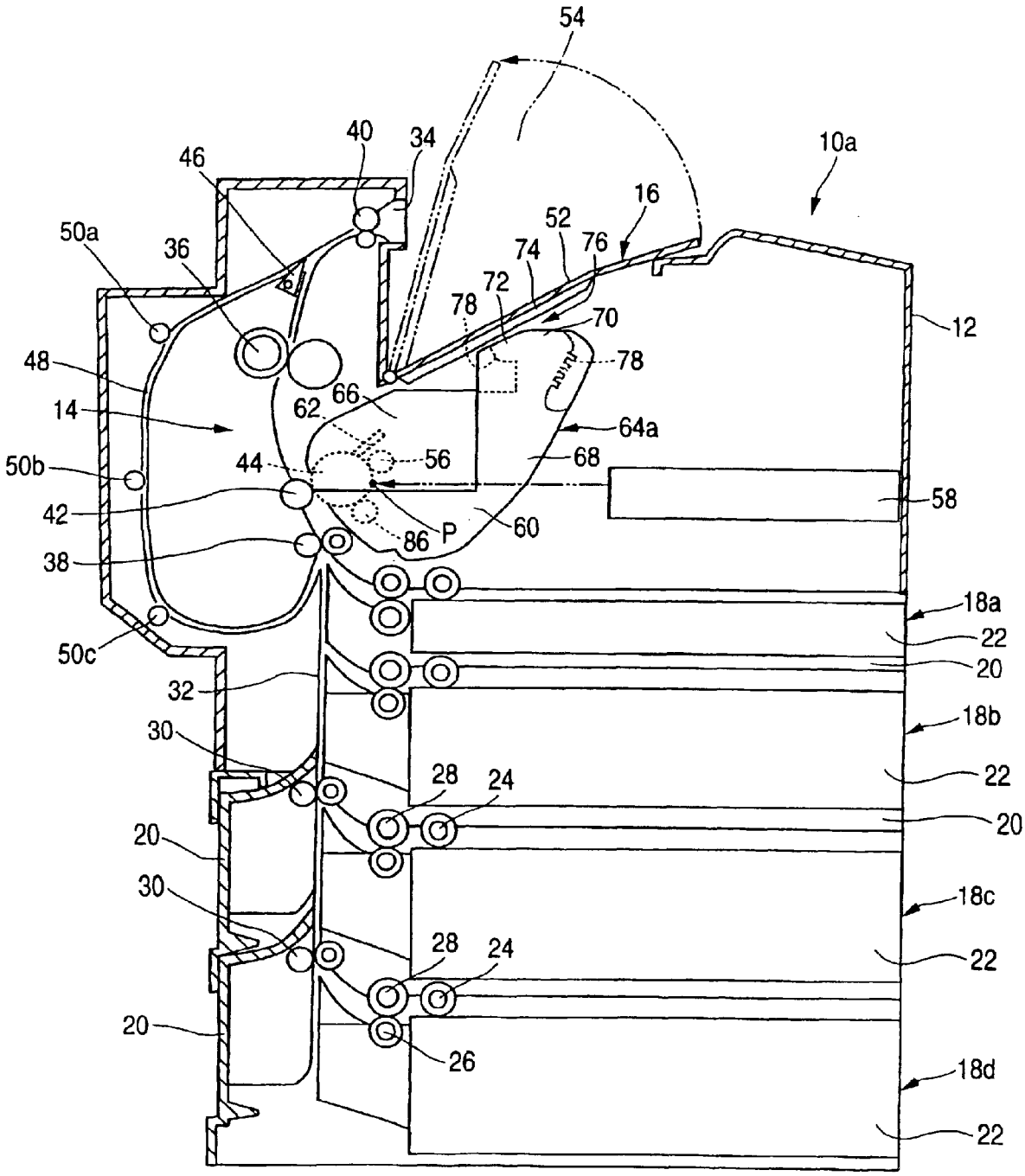
FIG. 1 is a sectional view for indicating an image forming apparatus according to a first embodiment mode of the present invention.
Figure 2:
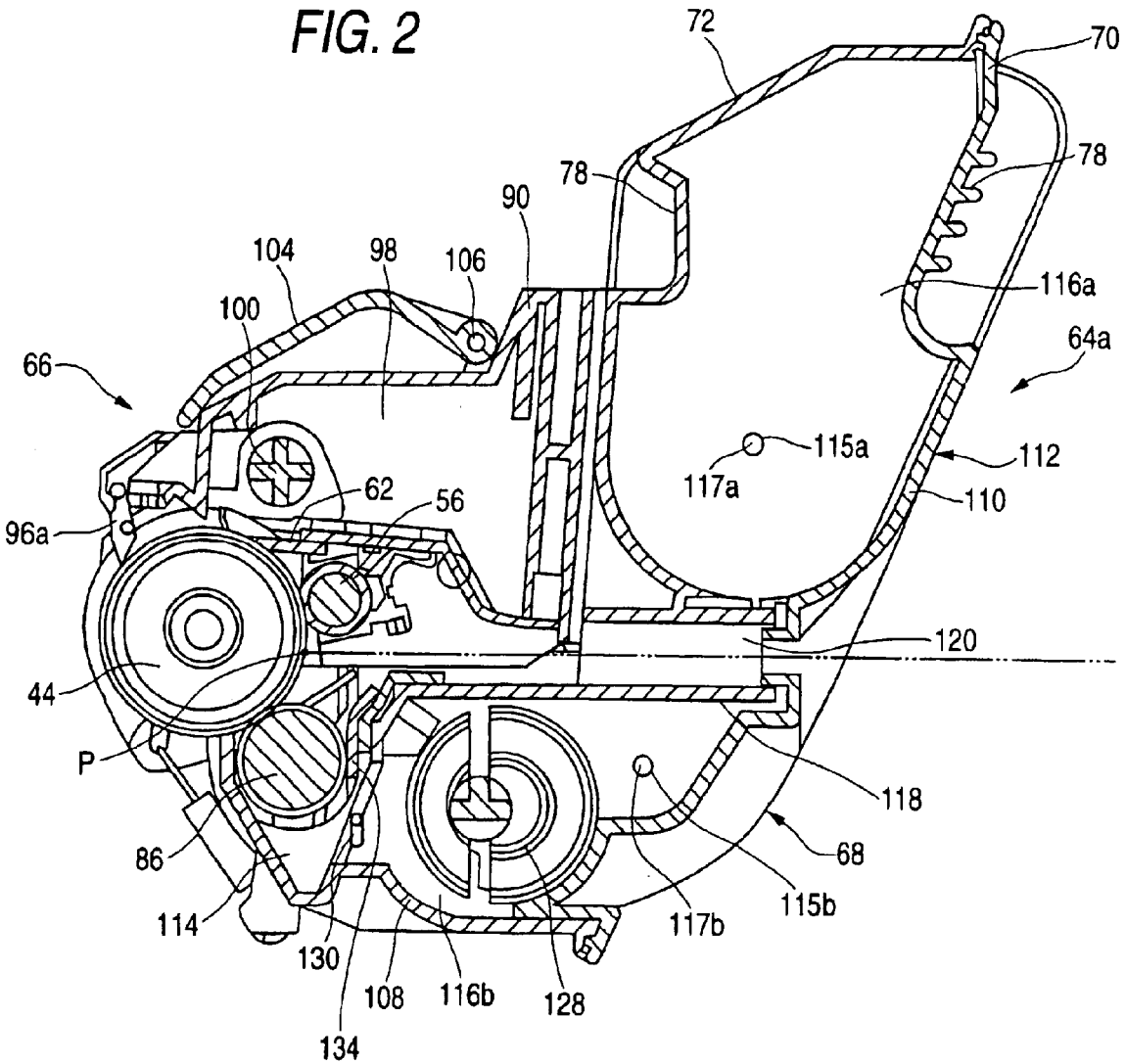
FIG. 2 is a sectional view for representing a process cartridge according to a first embodiment mode of the present invention.

FIG. 1 schematically shows an image forming apparatus 10*a* according to a first embodiment mode of the present invention. The image forming apparatus 10*a* contains a main body 12 of the image forming apparatus 10*a*. An image forming section 14 is mounted on this image forming apparatus main body 12. An ejection unit 16 (will be explained later) is provided at an upper portion of this image forming apparatus main body 12, and also, for instance, two stages of paper supply units 18*a* and 18*b* are arranged at a lower portion of this image forming apparatus main body 12. Furthermore, two stages of paper supply units 18*c* and 18*d* are arranged below the image forming apparatus main body 12, while these paper supply units 18*c* and 18*d* are detachably mounted thereon as an optical paper supply unit.

Each of the paper supply units 18*a* to 18*d* owns a paper supply unit main body 20 and a paper supply cassette 22 into which paper is stored. The paper supply cassette 22 is slidably mounted with respect to the paper supply unit main body 20, and is drawn out from this paper supply unit main body 20 along a front plane direction (namely, right direction of FIG. 1). Also, a paper supply roller 24 is arranged at an upper portion near an inner end of the paper supply cassette 22, and both a retard roller 26 and a nudger roller 28 are arranged in front of this paper supply roller 24. Furthermore, feed rollers 30 are provided with the optionally-provided paper supply units 18*c* and 18*d*, and these feed rollers 30 may constitute a pair of feed rollers.

A transport path 32 corresponds to a paper path defined from the feed roller 30 of the lowermost paper supply unit 18*d* up to an ejection port 34. While this transport path 32 is located in the vicinity of a rear surface (namely, left side surface viewed in FIG. 1) of the image forming apparatus main body 12, this transport path 32 owns such a portion which is formed along the substantially vertical direction from the feed roller 30 of the lowermost paper supply unit 18*d* up to a fixing apparatus 36 (will be discussed later). Both a transferring apparatus 42 (will be explained later) and an image carrier 44 (will be explained later) are arranged on an upper stream side of the fixing apparatus 36 of this transport path 32. Furthermore, a register roller 38 is arranged on an upper stream side of both the transferring apparatus 42 and the image carrier 44. In addition, an ejection roller 40 is arranged in the vicinity of an ejection port 34 of the transport path 32.

As a result, the recording mediums which are fed out from the paper supply cassettes 22 of the paper supply units 18*a* to 18*d* by the paper supply roller 24 are smoothly separated by the retard roller 26 and the nudge roller 28 to be conducted to the transport path 32, and then, are temporarily stopped by the register roller 38. After proper timing is controlled, a developed image is transferred to the recording medium while the recording medium is penetrated between the transferring apparatus 42 and the image carrier 44 (will be explained later), and this transferred developed image is fixed on the fixing apparatus 36, and then, the recording medium on which the fixed image has been formed is ejected from the ejection port 34 to the ejection unit 16 by the ejection roller 40.

It should be noted that when a double-surface printing mode is carried out, this recording medium is returned to an inversion path 48. In other words, a front path portion of the transport path 30 as to the ejection roller 40 is separated into two paths, a switching craw 46 is provided at this separated path portion, and the inversion path 48 is formed from this separated path portion up to the register roller 38. While transport rollers 50*a* to 50*c* are provided in this inversion path 48, in the case of the double-surface printing mode, the switching claw 46 is switched to such a side that the inverted at a time instant when a front edge portion of a recording medium is engaged with the ejection roller 40, so that this recording medium is conducted to the inversion path 48, and then, is penetrated through the register roller 38, the transfer apparatus 42, the image carrier 44, and the fixing apparatus 36 so as to be ejected from the ejection port 34 to the ejection unit 16.

The ejection unit 16 owns an inclination portion 52 which is freely pivotable with respect to the image forming apparatus main body 12. This inclination portion 52 is inclined in such a manner that an ejection port portion thereof is low and is gradually heightened toward a front surface direction (namely, right direction viewed in FIG. 1). This ejection port portion is used as a lower end of the inclination portion 52 and a tip portion which is heightened is used as an upper end thereof. This inclination portion 52 is supported with respect to the image forming apparatus main body 12 in such a manner that this inclination portion 52 is freely pivotable, while the lower end thereof is located at a center. As indicated by a two-dot/dash line in FIG. 1, when this inclination portion 52 is rotated toward the upper direction so as to be opened, an opening unit 54 is formed, and a process cartridge (will be explained later) 64 can be detachably mounted via this opening unit 54.

The image forming section 14 is made of, for instance, an electro-photographic type image forming unit. This image forming section 14 is arranged by the image carrier 44 constructed of a photosensitive material, a charging apparatus 56, an optical writing apparatus 58, a developing apparatus 60, a transferring apparatus 42, a cleaning apparatus 62, and a fixing apparatus 36. The charging apparatus 56 is constituted by, for example, a charge roller capable of uniformly charging the image carrier 44. The optical writing apparatus 58 writes a latent image in an optical manner on the image carrier 44 charged by the charging apparatus 56. The developing apparatus 60 develops the latent image of the image carrier 44, which has been formed by the optical writing apparatus 58, by way of developer so as to produce a visible image. The transferring apparatus 42 is constituted by, for example, a transfer roller which transfers the developed image by the developing apparatus 60 to paper. The cleaning apparatus 62 is constituted by, for instance, a blade which cleans the developer left on the image carrier 44. The fixing apparatus 36 is arranged by both a pressure-applying roller and a heating roller, by which the developed image which has been transferred onto the paper by the transferring apparatus 42 is fixed on this paper. The optical writing apparatus 58 is constructed of, for example, a scanning type laser exposing apparatus, and is arranged in parallel to the paper supply units 18*a* to 18*d*, and is located in the vicinity of a front surface of the image forming apparatus main body 12. As will be explained later, the optical writing apparatus 58 exposes the image carrier 44 by scanning light beams across the inner space of the developing apparatus 60. This exposing position of the image carrier 44 may constitute a latent image writing position "P." It should be noted that in this embodiment mode, the scanning type laser exposing apparatus has been employed as the optical writing apparatus 58. Alternatively, an LED (Light Emitting Diode), a surface emitting laser, and the like may be employed.

A process cartridge 64*a* according to the first embodiment mode is arranged by employing the image carrier 44, the charging apparatus 54, the developing apparatus 60, and the cleaning apparatus 62 in an integral body. This process cartridge 64*a* is arranged just under the inclination portion 52 of the ejection unit 16, and as previously explained, is detachably mounted via the opening portion 54 which is formed when the inclination portion 52 is opened.

This process cartridge 64*a* is detachably separated into a first cartridge unit 66 and a second cartridge unit 68. In the first cartridge unit 66, the image carrier 44, the charging apparatus 54, and the cleaning apparatus 62 are arranged. In the second cartridge unit 68, the developing apparatus 60 is arranged. The first cartridge unit 68 owns a developer-storing housing unit 70 which constitutes a second developer storage unit (will be discussed later). Also, an upper wall plane 72 which constitutes the developer-storing housing unit 70 is formed in such a manner that this upper wall plane 72 is located in parallel to the inclination portion 52 and along this inclination portion 52. Also, a plurality of ribs 74 are formed on a lower surface of the inclination portion 52 in such a way that these plural ribs 74 are positioned in parallel to each other along the inclination direction of the inclination portion 52. Since these ribs 74 are formed, a flow path 76 is formed between the inclination portion 52 and the process cartridge 64*a*. This flow path 76 is employed so as to penetrate air therethrough, and this flow path 76 may disperse heat produced from the fixing apparatus 36. Furthermore, a grip portion 78 is formed on the upper portion of the developer-storing housing unit 70. This grip portion 78 is formed in such a manner that wall surfaces of both sides of the upper portion of the developer-storing housing unit 70 are entered into the inside thereof. When the process cartridge 64*a* is detachably mounted, this process cartridge 64*a* can be readily detachably mounted by gripping this grip portion 78.

In FIG. 2 to FIG. 8, a detailed construction of the process cartridge 64*a* is indicated. As explained above, the process cartridge 64*a* is arranged by the first cartridge unit 66 and the second cartridge unit 68, and this first cartridge unit 66 is coupled to the second cartridge unit 68 via coupling pins 80*a* and 80*b* in such a manner that this first cartridge 66 is freely pivotable with respect to the second cartridge unit 68. Also, both the first cartridge unit 66 and the second cartridge 68 are energized with each other by a tension spring 82 and a depression spring 84, and a developing roller 86 is depressed against the image carrier 44.

It should also be understood that a memory 88*a* and a memory 88*b* for storing thereinto a total print number and information as to mounting/dismounting of the second developer storage unit are provided on a side surface of the first cartridge unit 66 and a side surface of the second cartridge unit 68, respectively.

The first cartridge unit 66 owns a main body 90 of the first cartridge unit 66, and both the image carrier 44 and the charging apparatus 56 are supported by this first cartridge unit main body 90 in such a manner that both the image carrier 44 and the charging apparatus 56 are rotatably supported by this first cartridge unit main body 90 via bearings 92*a* and 93*b* used for the image carrier 44, and bearings 94*a* and 94*b* used for the charging apparatus 56, respectively. The bearing 94*a* and bearing 94*b* for the charging apparatus 56 own another function of a power supply portion. Also, for example, two fingers 96*a* and 96*b* are supported by the first cartridge unit main body 90 in such a manner that these fingers 96*a* and 96*b* are freely pivotable with respect to this first cartridge unit main body 90. Since tip portions of these fingers 96*a* and 96*b* are depressed by a spring for the fingers 96*a* and 96*b* on the surface of the image carrier 44, a recording medium which will wrap the image carrier 44 is stripped by these tip portions. Also, a developer collecting space 98 is formed above the cleaning apparatus (cleaning blade) 62 within the first cartridge unit main body 90, and thus, developer which has been scratched/dropped by the cleaning apparatus 62 is collected into this developer collecting space 98. A paddle 100 is rotatably provided in this developer collecting space 98. This paddle 100 is supported via a gear 102 for the paddle 100 by the first cartridge unit main body 90, and transports the developer which has been collected by being rotated to an inner side of the developer collecting space 98. Also, a shutter 104 is provided at the upper portion of the first cartridge unit main body 90 in such a manner that this shutter 104 can be freely opened/closed. This shutter 104 is supported via a shaft 106 for the shutter 104 with respect to the first cartridge unit main body 90 in a freely movable manner. This shutter 104 closes an opening portion of the image carrier 44 before the process cartridge 64*a* is mounted, and is opened in order that the image carrier 44 is come out to the front in the case that the process cartridge 64*a* is mounted.

The second cartridge unit 68 contains a main body 112 of the second cartridge unit 68 which is constituted by jointing a front housing 108 to a rear housing 110. The second cartridge unit 68 is segmented into the developer-storing housing unit 70 which is the upper part of the second cartridge unit main body 112, and a developing unit 114 in which a first developer storage portion 116*a* and a second developer storage portion 116*b* are arranged. While a horizontal line extended from the latent image writing position "P" is defined as a boundary, the developer-storing housing unit 70 is located at an upper portion of this horizontal line, and the first developer storage portion 116*a* is provided via a partition wall 118 at a lower portion of this developer-storing housing unit 70. In this embodiment mode, this horizontal line corresponds to an optical scanning path originated from the optical writing apparatus 58.

Figure 3:
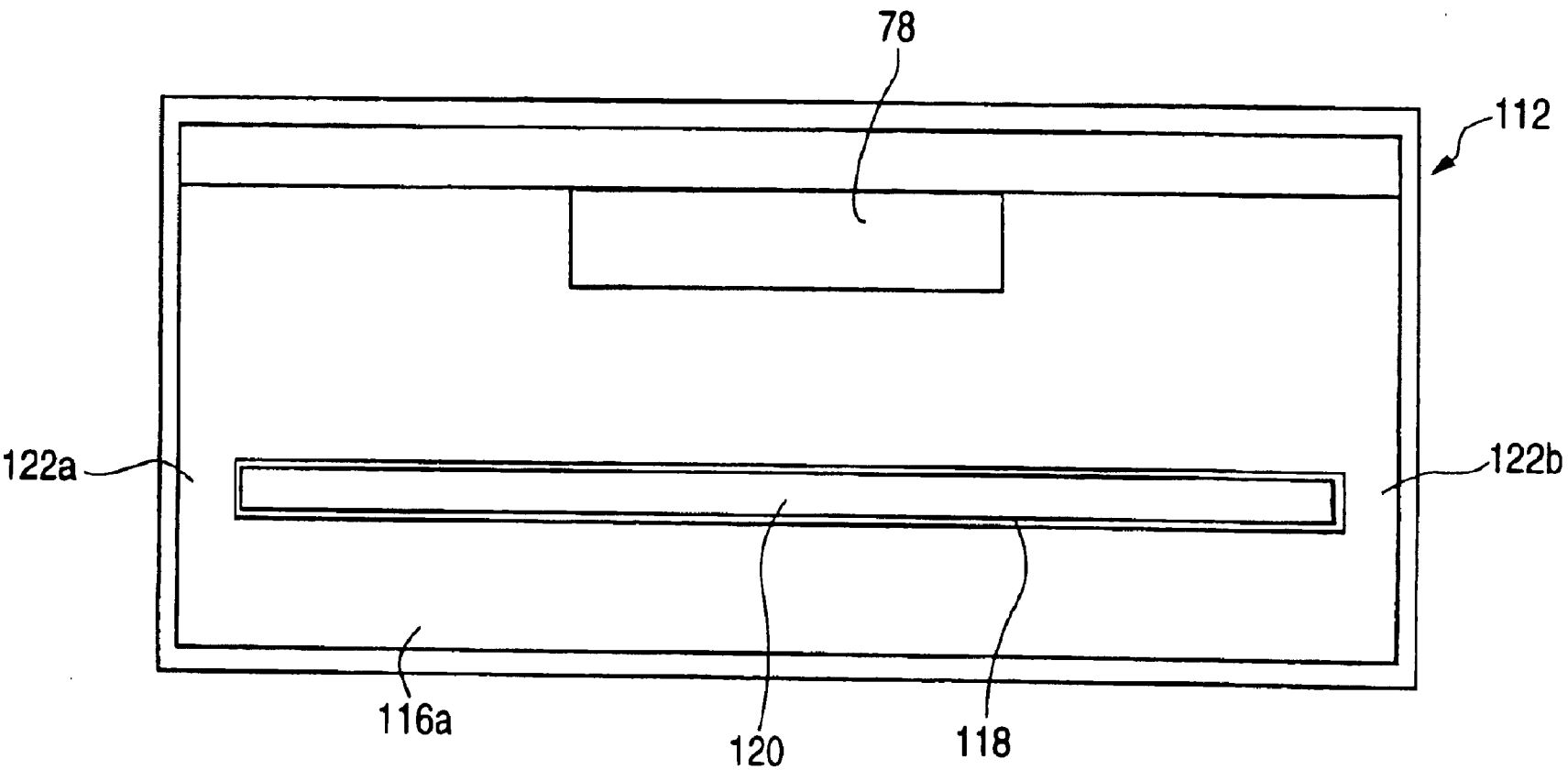
FIG. 3 is a side view for showing a supply path of developer in the process cartridge according to the first embodiment mode of the present invention.
Figure 4:
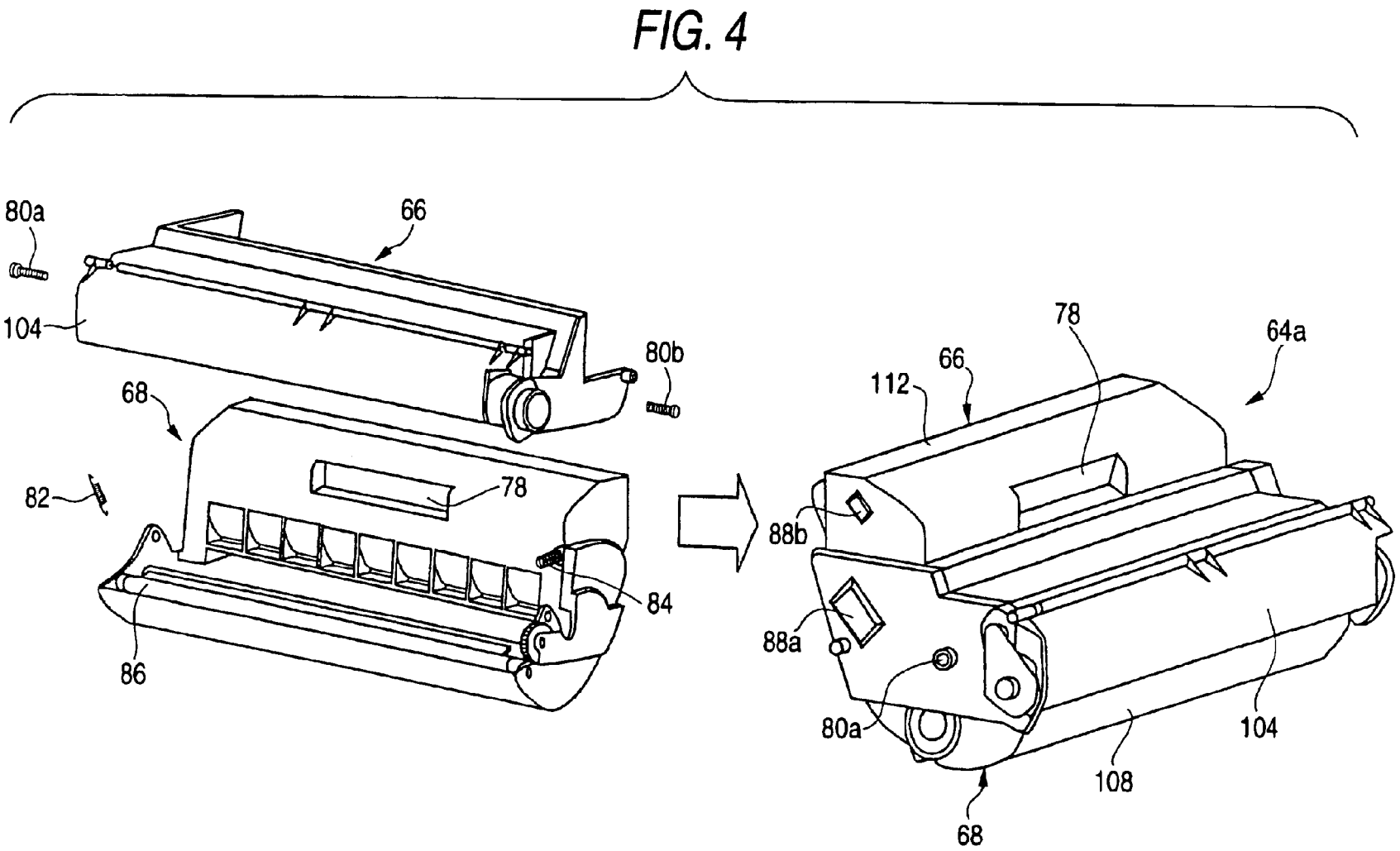
FIG. 4 is a perspective view for indicating the process cartridge according to the first embodiment mode of the present invention.
Figure 5:
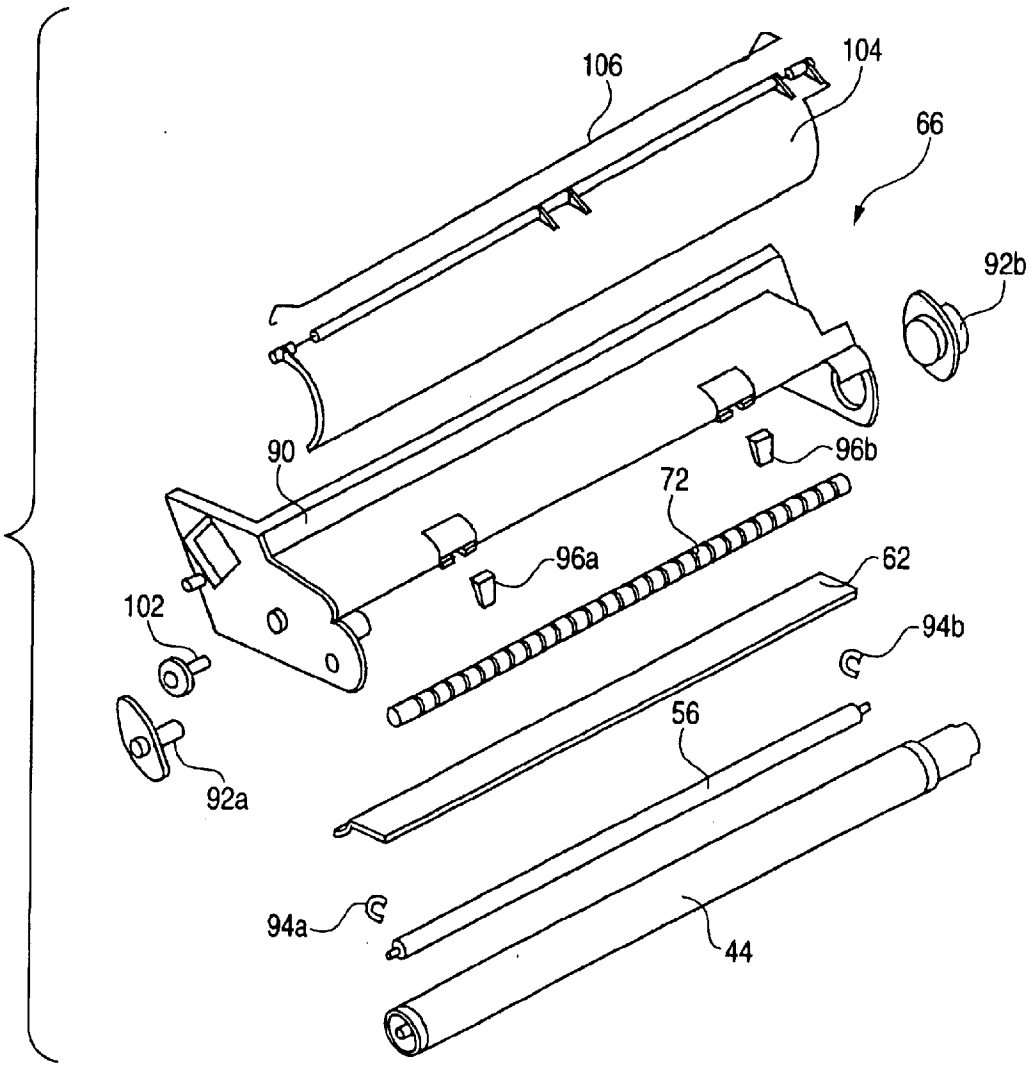
FIG. 5 is an exploded perspective view for indicating a first cartridge unit of the process cartridge according to the first embodiment mode of the present invention.
Figure 6:
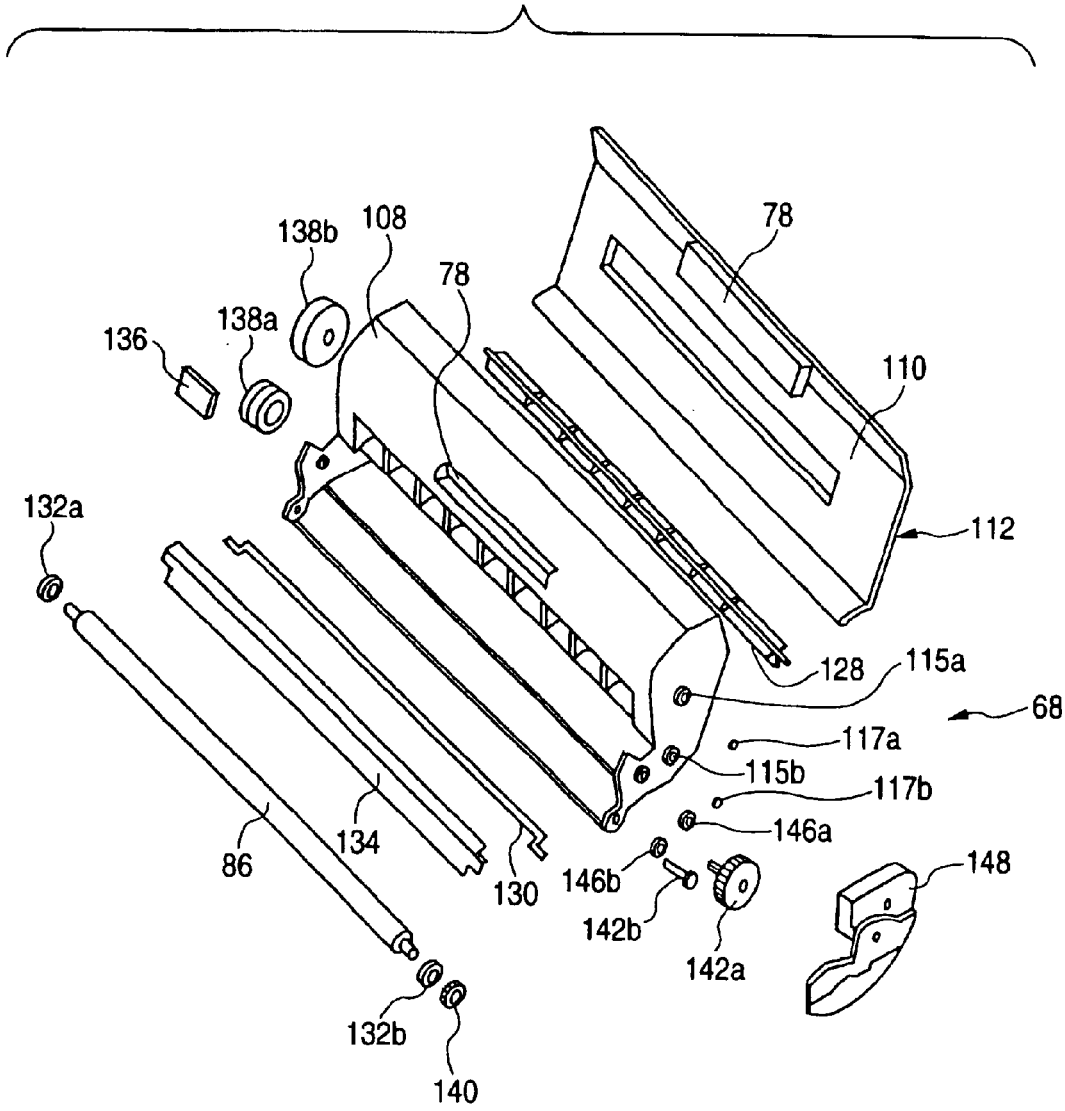
FIG. 6 is an exploded perspective view for representing a second cartridge unit of the process cartridge according to the first embodiment mode of the present invention.
Figure 7:
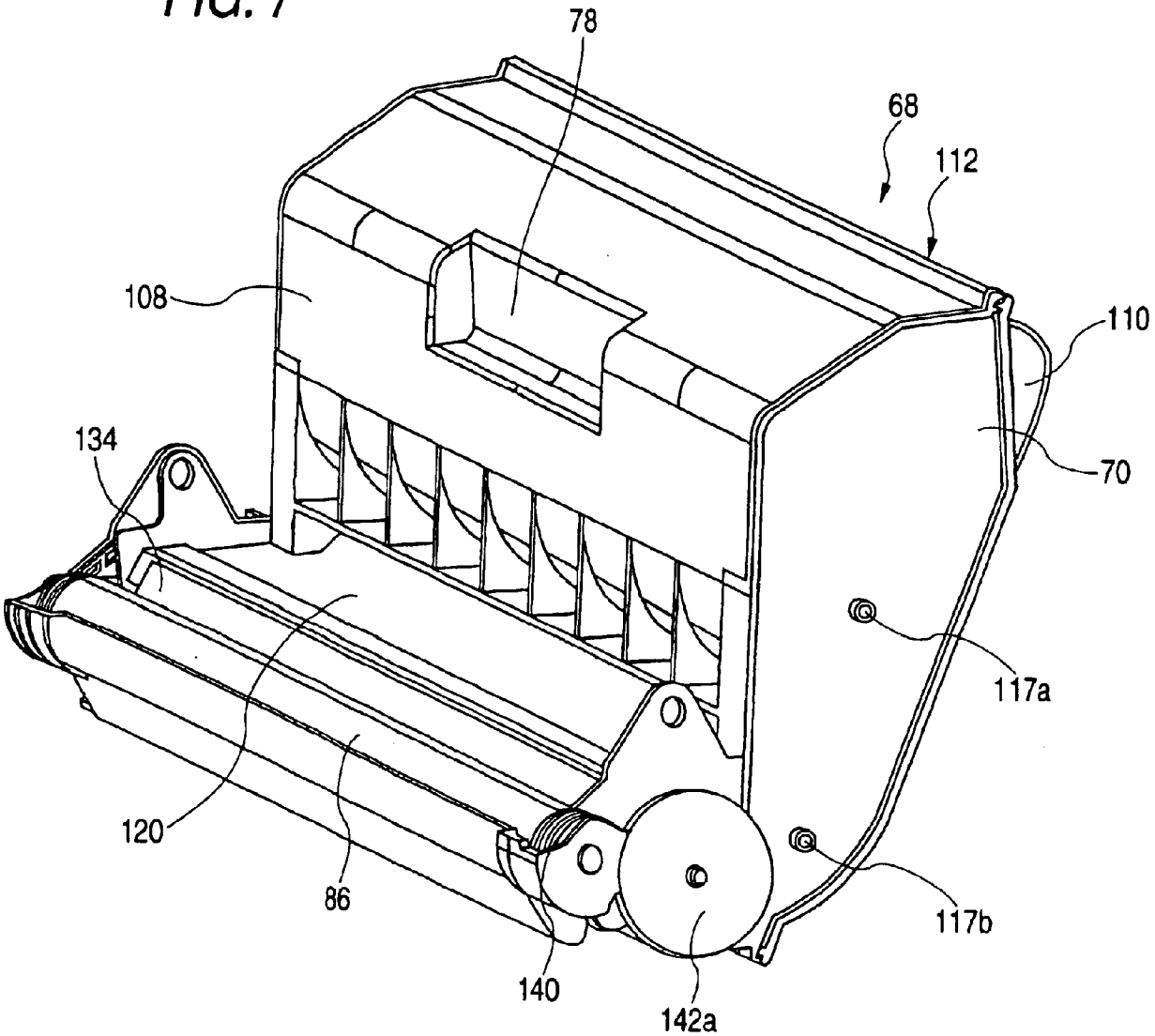
FIG. 7 is a perspective view for showing the second cartridge unit of the process cartridge according to the first embodiment mode of the present invention.
Figure 8:
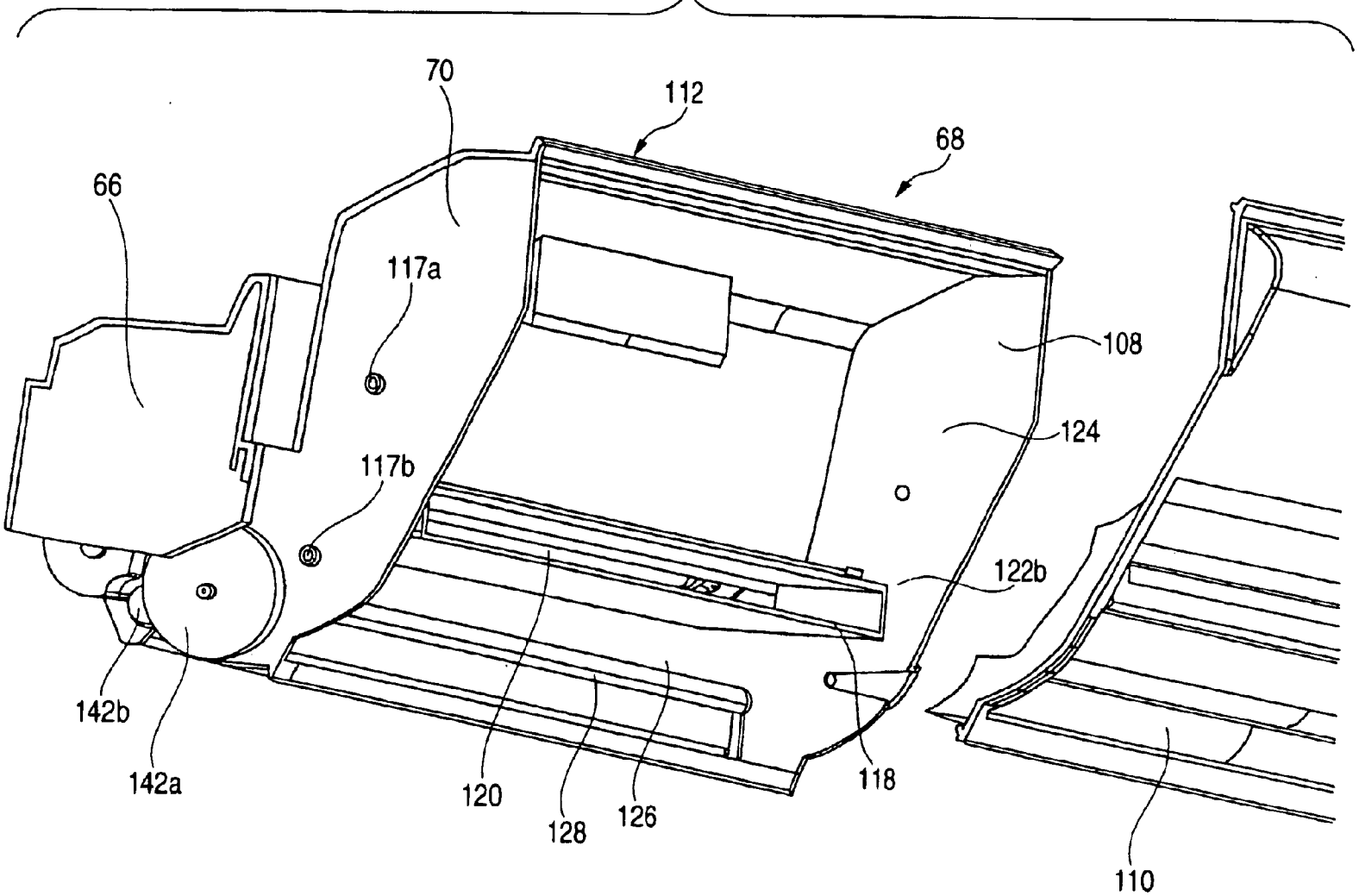
FIG. 8 is an exploded perspective view of the second cartridge unit of the process cartridge according to the first embodiment mode of the present invention, as viewed from a rear surface of the developing appliance unit.
Figure 9:
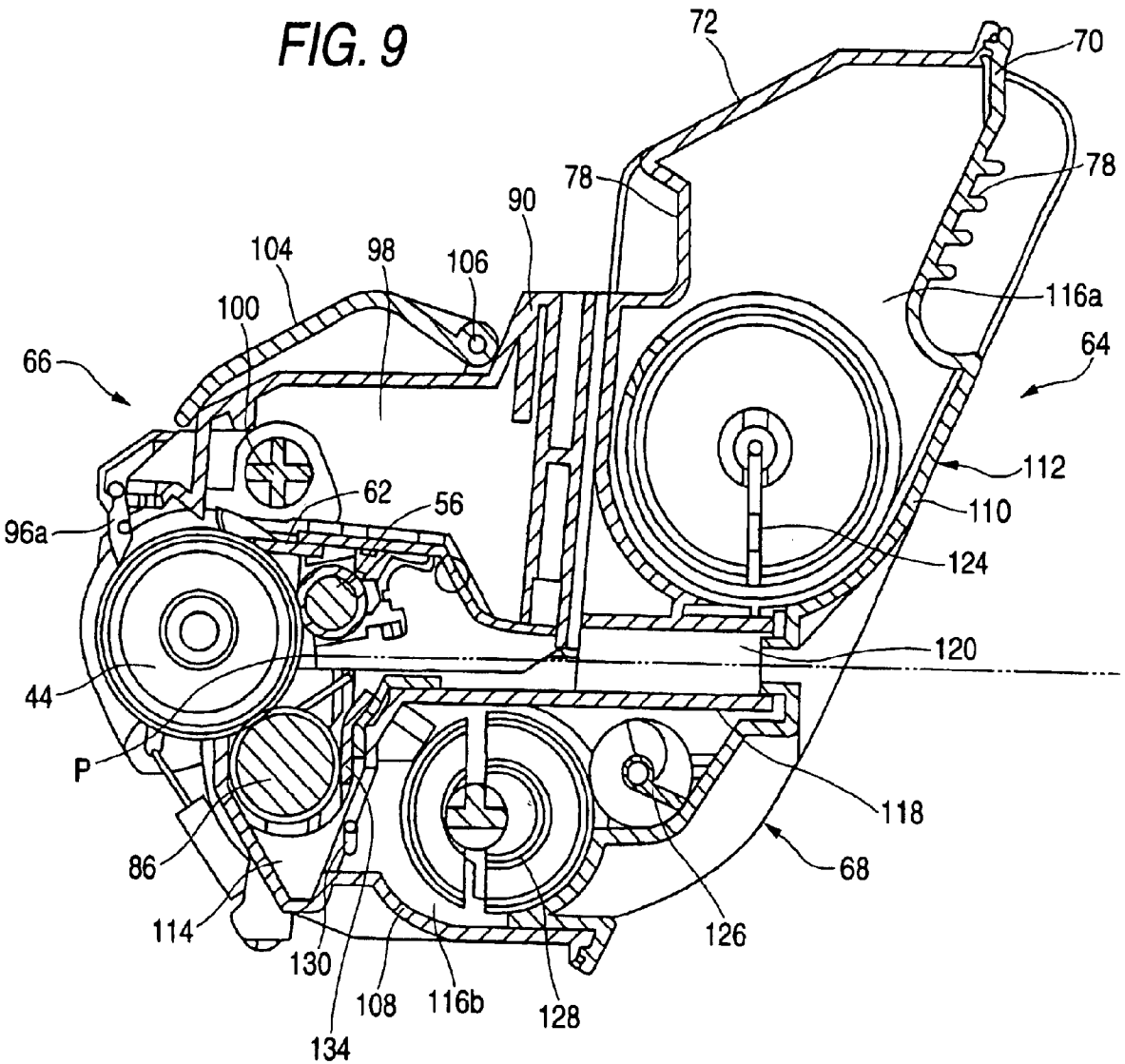
FIG. 9 is a sectional view for representing a process cartridge according to a second embodiment mode of the present invention.
Figure 10:
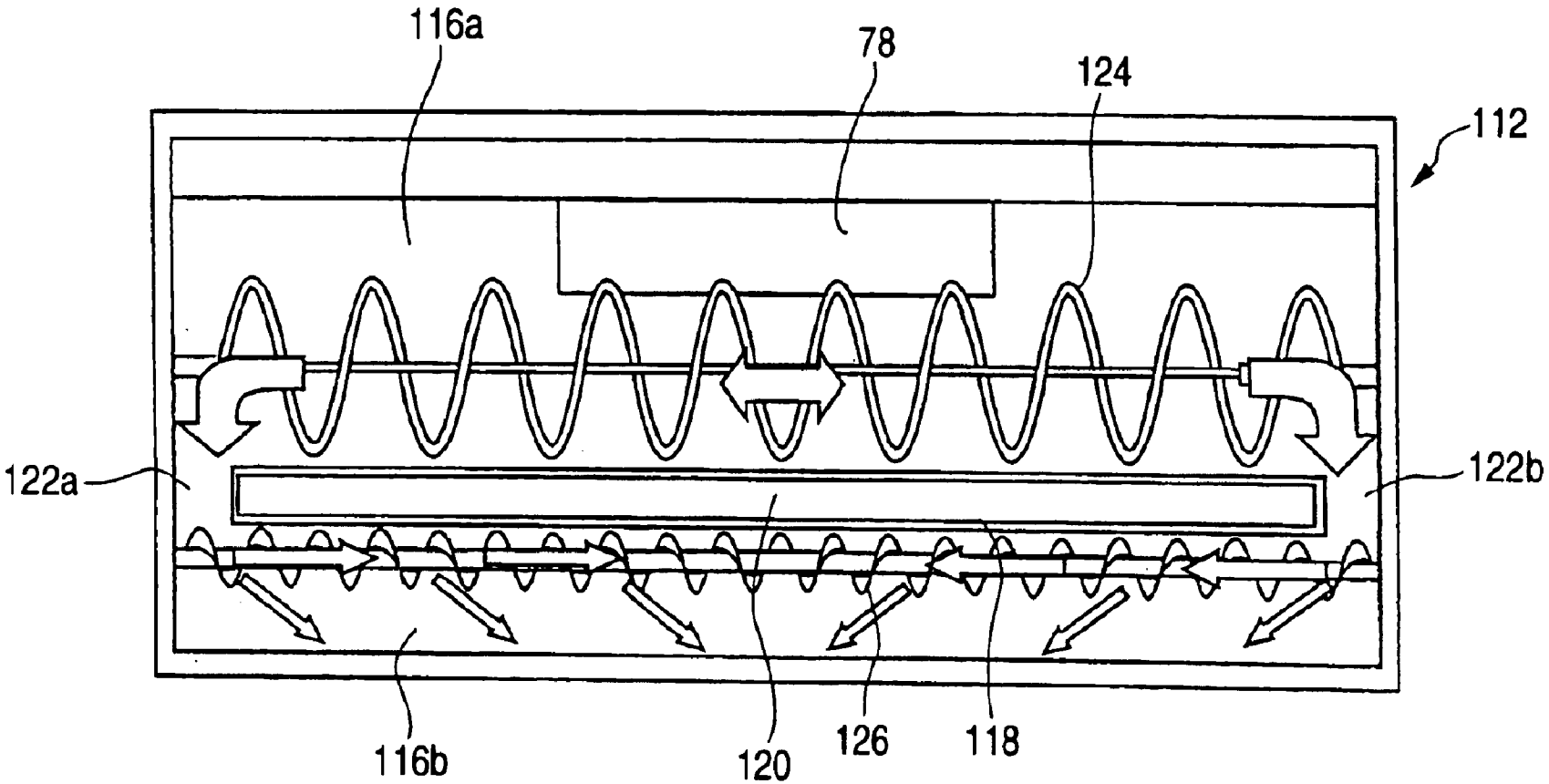
FIG. 10 is a side view for showing a supply path of developer in the process cartridge according to the second embodiment mode of the present invention.
Figure 11:
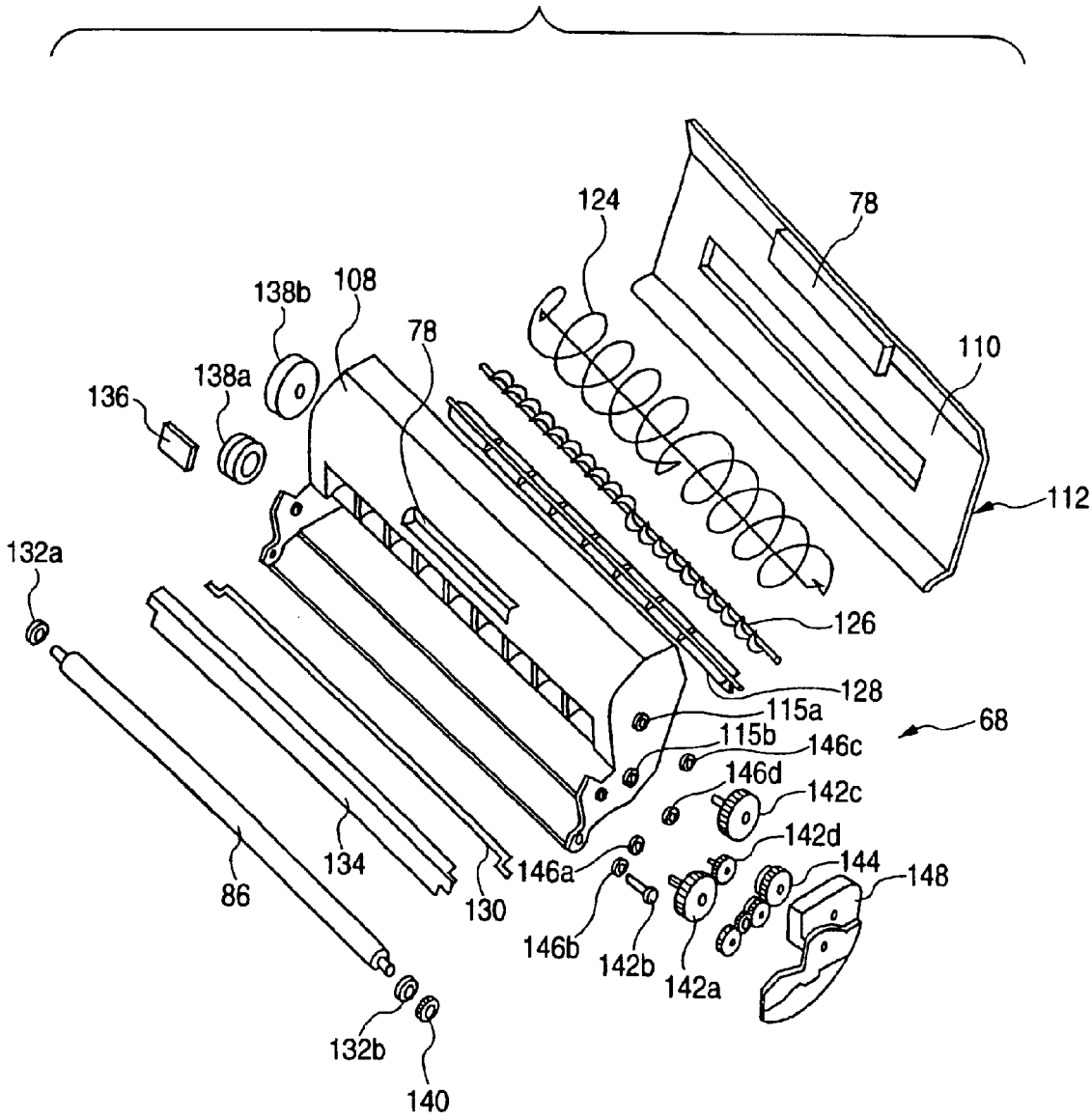
FIG. 11 is an exploded perspective view for indicating a second cartridge unit of the process cartridge according to the second embodiment mode of the present invention.
Figure 12:
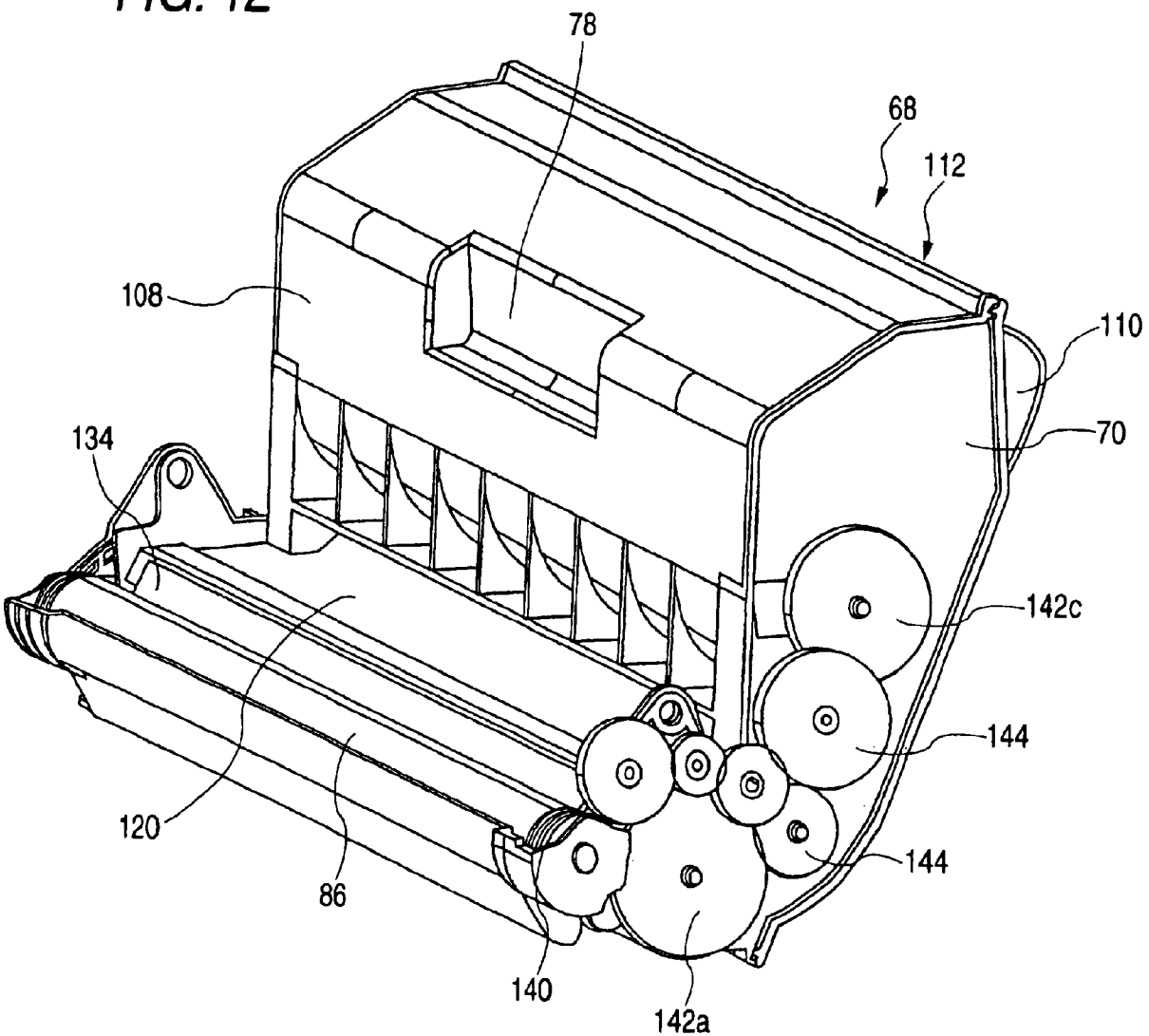
FIG. 12 is a perspective view for showing the second cartridge unit of the process cartridge according to the second embodiment mode of the present invention.
Figure 13:
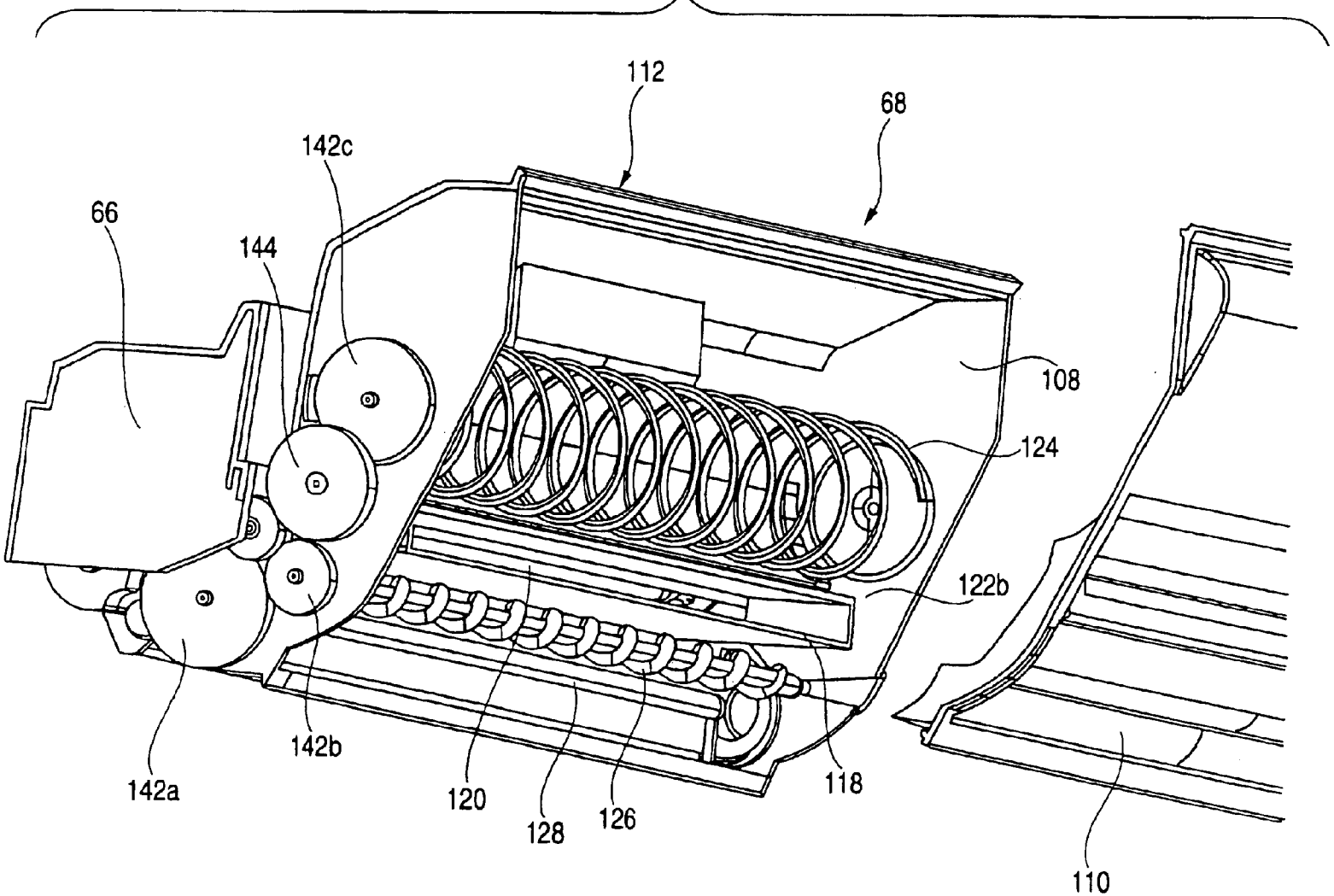
FIG. 13 is an exploded perspective view of the second cartridge unit of the process cartridge according to the second embodiment mode of the present invention, as viewed from a rear surface of the developing appliance unit.

As shown in FIG. 3, the partition wall 118 constitutes a window portion 120 having, for example, a rectangular shape, which forms the optical scanning path defined from the optical writing apparatus 58. Also, this partition wall 118 constitutes developer paths 122*a* and 122*b* and the second cartridge unit main body 112 on both sides of this window portion 120. Both the developer paths 122*a* and 122*b* cause the first developer storage portion 116*a* to be communicated with an inner portion of the developer-storing housing unit 70. The developer-storing housing unit 70 is employed so as to constitute a second developer storage unit by adding a stirring/transporting member and the like. In this first embodiment mode, the stirring/transporting member and the like are not mounted, but a hole 115*a* for a first stirring/transporting member, which is used to rotatably hold the stirring/transporting member, is formed in the developer-storing housing unit 70. This first stirring/transporting member hole 115*a* is tightly sealed by a first hole tight-sealing seal member 117*a*. A stirring/transporting member may also be mounted on a lower portion of the partition wall 118 in the first developer storage unit 116*a*. However, in this first embodiment mode, such a stirring/transporting member is not mounted, but a hole 115*b* for a second stirring/transporting member, which is employed to rotatably hold the stirring/transporting member, is formed. This second stirring/transporting member hole 115*b* is similarly sealed by a second hole tight-sealing seal member 117*b*.

Furthermore, both a first stirring/transporting member 128 and a second stirring/transporting member 130 are arranged in the first developer storage portion 116*a*. The first stirring/transporting member 128 transports the developer stored in the first developing storage unit 116*a* to the second stirring/transporting member 130. This second stirring/transporting member 130 is arranged at an output port of the first developing member storage portion 116*a*. The second stirring/transporting member 130 transports the developer which has been transported by the second stirring/transporting member 128 to the developing roller 86, and also, mixes this new developer with the deteriorated developer which has been scratched/dripped from the developing roller 86.

As is well known in the field, the developing roller 86 is constructed in such a manner that a sleeve is wound on a magnet roller, and tracking caps 132*a* and 132*b* are provided on both sides of the magnet roller. These tracking caps 132*a* and 132*b* are made in contact to the image carrier 44, and as explained in the above description, a developing gap may be secured by depressing these tracking caps 132*a* and 132*b* against the image carrier 44 by both the tension spring 82 and the depression spring 84. A layer thickness restricting member 134 made of, for instance, are sin is made in contact with the developing roller 86. A thickness of a developer layer adhered on the surface of the developing roller 86 is restricted by this layer thickness restricting member 134. Also, a side surface of this developing roller 86 is sealed by a developing portion sealing member 136.

It should also be noted that reference numerals 138*a* and 138*b* indicate developer caps which are detachably mounted on the second cartridge unit main body 112. Since these developer caps 138*a* and 138*b* are pulled out, the developer is supplied to either the first developer storage unit 116*a*, or the second developer storage unit 116*b*.

In the drive system of the process cartridge 64*a*, drive force is transferred from the side of the image carrier 44, and then, is transferred to a developing roller gear 140, and also gears 142*a* and 142*b* for the respective stirring/transporting members. Stirring/transporting member sealing members 146*a* and 146*b* are inserted into bearing portions of the stirring/transporting member gears 146*a* and 146*b*. Furthermore, a gear cover 146 is provided on the side surface of the second cartridge unit main body 112, while this gear cover 146 covers the gear 142*a* and 142*b* for the respective stirring/transporting members and the developing roller gear 140.

Next, operations of the image forming apparatus according to the first embodiment mode will now be described.

While the image carrier 44 is uniformly charged by the charging apparatus 56, light emitted from the optical writing apparatus 58 is irradiated onto this charged image carrier 44 in response to an image signal, and then, a latent image is formed at the latent image forming position "P" thereof. The light emitted from the optical writing apparatus 58 passes through the process cartridge 64*a* via the window portion 120 of the process cartridge 64*a*. The latent image which has been formed on the image carrier 44 by this optical writing apparatus 58 is developed by the developer of the developing apparatus 60 so as to produce a visible image.

While the developer has been stored in the first developer storage portion 116*a*, the developer stored in the first developer storage portion 116*a* is transported to the developing unit 114 by rotating the first stirring/transporting member 128, and the second stirring/transporting member 130. In this developing unit 114, the transported developer is adhered onto the developing roller 86, the layer thickness of the adhered developer is restricted by the layer thickness restricting member 134, the thickness restricted developer is transported up to a developing position located opposite to the image carrier 44, and then, an image made of the developer is formed in correspondence with the latent image of the image carrier 44.

On the other hand, one of the paper supply units 18*a* to 18*d* is selected in response to a size signal and the like, recording mediums stored in one of these paper supply cassettes 22 are fed out by the paper supply roller 24, and these recording mediums are smoothly separated by the retard roller 26 and the nudger roller 28 so as to conduct a recording medium to the transport path 32. Then, this conducted recording medium is temporarily stopped by the register roller 38, and thereafter, this recording medium is conducted between the transferring apparatus 42 and the image carrier 44 at proper timing.

When the recording medium is conducted between the transferring apparatus 42 and the image carrier 44 in this manner, the developer on the image carrier 44 is transferred to the recording medium by the transferring apparatus 42. This recording medium to which the developer has been transferred is penetrated through the fixing apparatus 36, and then is ejected from the ejection port 34 to the ejection unit 16.

In this first embodiment mode, the developer is stored only in the first developer storage unit 116*a*, the developer storage capacity is determined by the capacity of the first developer storage unit 116*a*, and thus, the lifetime of the process cartridge 64*a* is short which can be used by filling the developer one time. However, if there are the first stirring/transporting member 128, the second stirring/transporting member 130 in the first developer storage unit 116*a*, and the drive system for driving these first/second stirring/transporting members 128/130, then the developer can be transported. A total number of structural components can be reduced and the image forming apparatus can be made in low cost.

FIG. 9 to FIG. 13 indicate a process cartridge 64*b* according to a second embodiment mode of the present invention. The process cartridge 64*b* according to this second embodiment mode owns such a different point that both a third stirring/transporting member 124 and a fourth stirring/transporting member 126 are employed so as to constitute a second developer storage unit 116*b*, as compared with the process cartridge 64*a* according to the first embodiment mode.

In other words, while the first hole tight-sealing seal member 117*a* in the process cartridge 64*a* according to the first embodiment mode is dismounted, both ends of the third stirring/transporting member 124 are inserted into the first stirring/transporting member hole 115*a*, so that the third stirring/transporting member 124 is rotatably held by the developer-storing housing unit 70. As a result, the second developer storage unit 116*b*. A developer storage capacity of this second developer storage unit 116*b* is made larger than that of the first developer storage unit 116*a*. Also, while the second hole tight-sealing seal member 117*b* in the process cartridge 64*a* according to the first embodiment mode is dismounted, both ends of the fourth stirring/transporting member 126 are inserted into the second stirring/transporting member hole 115*b*, so that the fourth stirring/transporting member 126 is rotatably held by a rear housing 110. While the third stirring/transporting member 124 is arranged above the partition wall 118, this third stirring/transporting member 124 is constituted by such a wire member which is formed in a helical shape along different winding directions to each other. The third stirring/transporting member 124 supplies the developer stored in the second developer storage unit 116*b* to the developer paths 122*a* and 122*b*. Also, a fourth stirring/transporting member 126 is arranged below the partition wall 118. This fourth stirring/transporting member 126 is constituted by a screw shaft formed along different directions from edge portions thereof (viewed along axial direction) toward a center portion thereof. In order that the developer is uniformly dispersed by the fourth stirring/transporting member 126, the developer supplied from the developer paths 122*a* and 122*b* formed on the both sides may be transported along the center direction. As a consequence, as indicated by an arrow of FIG. 10, the developer which has been stored in the second developer storage unit 116*b* is transported to the both sides of the third stirring/transporting member 124 by rotating this third stirring/transporting member 124, and then, is dropped via the developer paths 122*a* and 122*b* to the first developer storage unit 116*a*, and thereafter is uniformly dispersed by rotating the fourth stirring/transporting member 126, so that the dispersed developer is transported to the first stirring/transporting member 128.

In a drive system of the process cartridge 64*b* according to this second embodiment mode, stirring/transporting member gears 142*c*/142*d*, and an idle gear 144 are additionally employed which are coupled to both the third stirring/transporting member 124 and the fourth stirring/transporting member 126. Also, stirring/transporting unit sealing members 146*c* and 146*d* are additionally inserted into bearing portions of the stirring/transporting member gears 142*c* and 142*d*. Any of the third stirring/transporting member 124, the fourth stirring/transporting member 126, the stirring/transporting member gears 142*c*/142*d*, and the idle gear 144 may be readily and detachably mounted.

As a consequence, in this process cartridge 64*b* according to the second embodiment mode, the developer storage capacity is increased by additionally providing the second developer storage unit 116*b*, as compared with the developer storage capacity of the process cartridge 64*a* according to the first embodiment mode.

It should be noted that the same reference numerals employed in the process cartridge 64*a* according to the first embodiment mode will be used as those for denoting the same, or similar structural elements, and explanations thereof are omitted.

Figure 14:
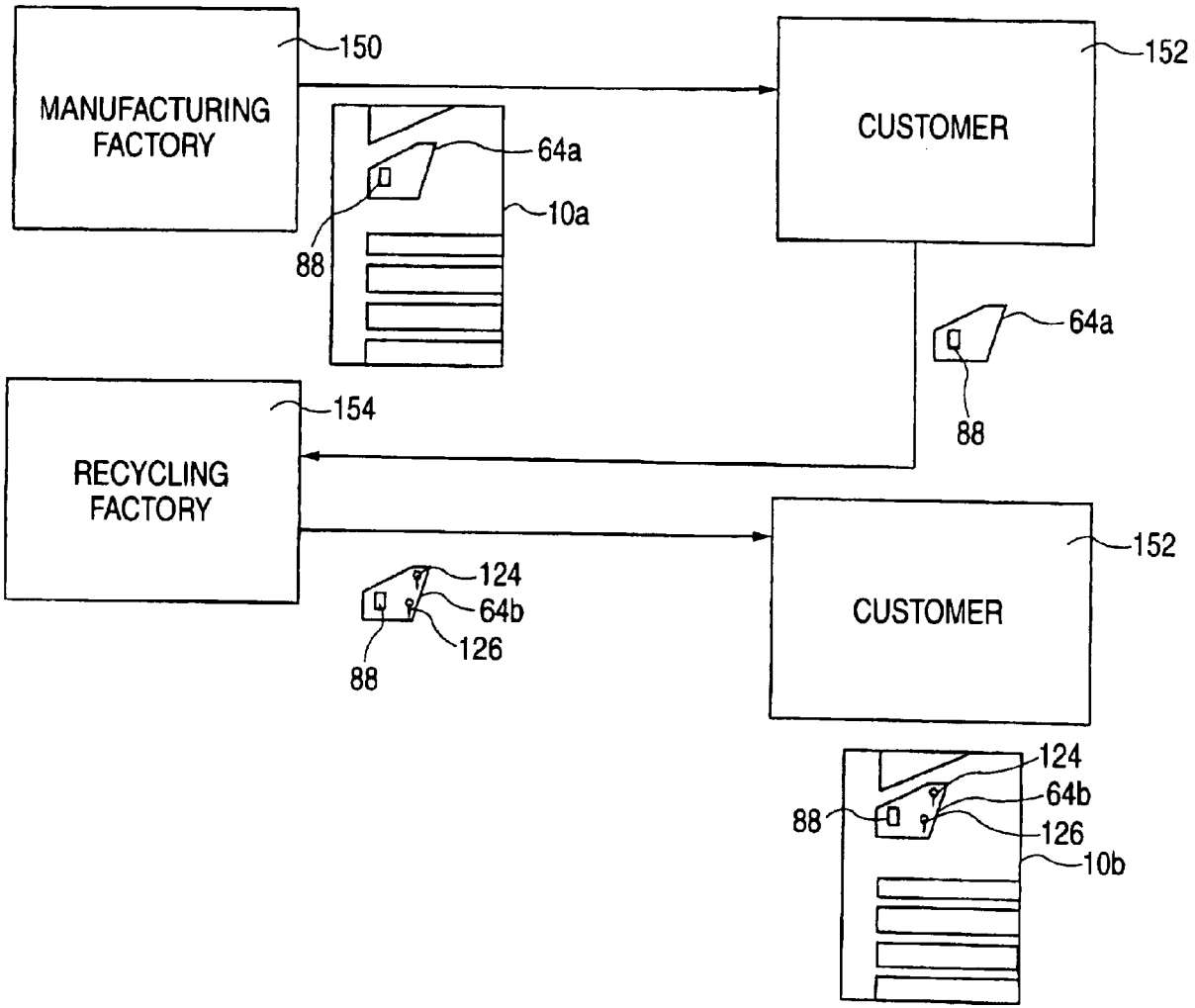
FIG. 14 is an explanatory diagram for showing one example of a recycling method according to an embodiment mode of the present invention.

In FIG. 14, there is shown one example of a recycling method of a process cartridge. First, while an image forming apparatus 10*a* which has been newly manufactured in a manufacturing factory 150 corresponds to that of the first embodiment mode, both a third stirring/transporting member and a fourth stirring/transporting member are not mounted on the process cartridge 64*a*, but developer is filled into only a first developer storage unit and then the resulting process cartridge is shipped. At this time, such a fact that this shipped cartridge corresponds to the process cartridge 64*a* according to the first embodiment mode is stored in either any one or both the memory 88*a* and the memory 88*b*. That is to say, such a fact that this shipped process cartridge is not equipped with the second developing member storage unit is stored in either any one or both the memory 88*a* and the memory 88*b*. Next, at a customer 152, if the image forming apparatus 10*a* is used, then the developer stored in the first developer storage unit is soon or later depleted, or decreased, so that a replacement time period of this process cartridge 64*a* becomes effective. In this case, the process cartridge 64*a* according to the first embodiment mode is collected to be carried to a recycling factory 154. At this recycling factory 154, both the third stirring/transporting member 124 and the fourth stirring/transporting member 126, and also other necessary components (the stirring/transporting member gears etc.) are mounted on this collected process cartridge 64*a*, so as to manufacture such a process cartridge 64*b* according to the second embodiment mode. At this time, such a fact that the manufactured process cartridge 64*b* corresponds to the process cartridge according to the second embodiment mode is stored in the memory 88. In other words, such an information that both the third stirring/transporting member 124 and the fourth stirring/transporting member 126 have been mounted on this process cartridge 64*b* is stored in the memory 88.

Since such a recycling method is employed, the firstly shipped image forming apparatus 10*a* is not equipped with the third stirring/transporting member and the like, so that a total number of structural members can be made small and this image forming apparatus 10*a* can be manufactured in low cost. On the other hand, after this image forming apparatus 10*a* has been collected, since the second developer storage unit is provided by accepting the request of the customer, the developer storage capacity can be increased. When the customer requires the increase of this developer storage capacity, this requirement may be met by merely adding the third stirring/transporting member 124 and the like to the collected process cartridge 10*a*, and other structural components maybe commonly employed, so that the developer storage capacity may be easily controlled. Also, in such a case that the lifetime of the first cartridge unit 66 is different from the lifetime of the second cartridge unit 68, only such a cartridge unit having a shorter lifetime may be replaced by new one.

It should be noted that the process cartridge 64*a* according to the first embodiment mode is employed at the beginning of the shipment, and after this process cartridge 64*a* has been collected, the process cartridge 64*b* according to the second embodiment mode is employed in the above-explained recycling method. Conversely, the process cartridge 64*a* according to the second embodiment mode may be employed at the beginning of the shipment, and after this process cartridge 64*b* has been collected, the process cartridge 64*a* according to the first embodiment mode may be employed in the above-explained recycling method. In this case, the process cartridge 64*a* according to the first embodiment mode and the process cartridge 64*b* according to the second embodiment mode are mixed with each other in either the manufacturing factory 150 or the recycling factory 154. However, since these process cartridges 64*a* and 64*b* may be discriminated from each other by checking outer appearances, for example, by checking as to whether or not the stirring/transporting member gears, an easy discrimination as to both the process cartridges 64*a*/64*b* may be carried out. Also, since such an information capable of discriminating these process cartridges 64*a*/64*b* from each other has been written into the memory 88, such an electronic cartridge discrimination may be realized. Thus, an image forming apparatus may be controlled based upon the information of this memory 88.

It should also be understood that the fourth stirring/transporting member 126 is also detachably mounted in the above-explained embodiment mode. Alternatively, while this fourth stirring/transporting member 126 is fixed, only the third stirring/transporting member 126 may be detachably mounted.

Figure 15:
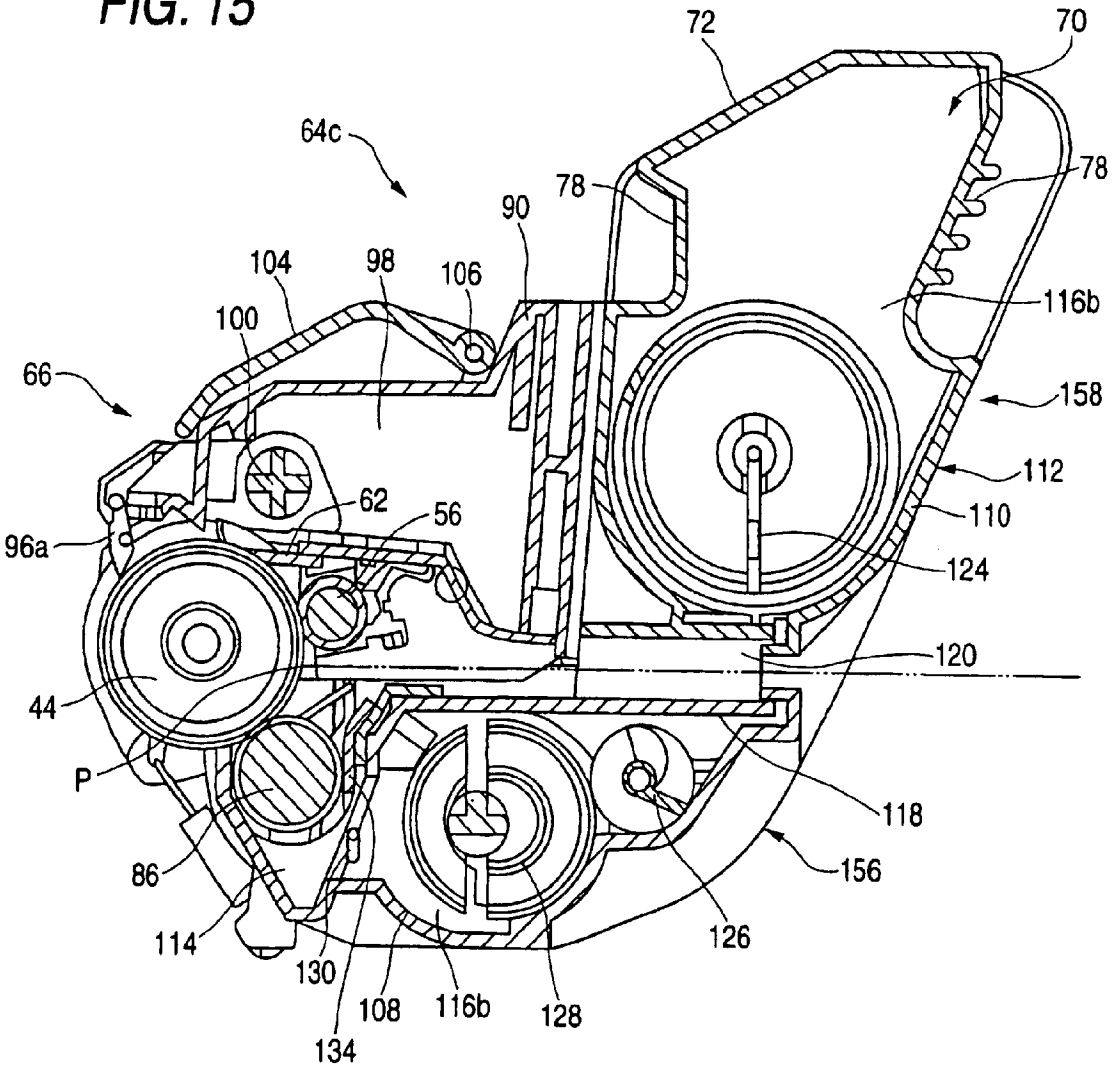
FIG. 15 is a sectional view for representing a process cartridge according to a third embodiment mode of the present invention.
Figure 16:
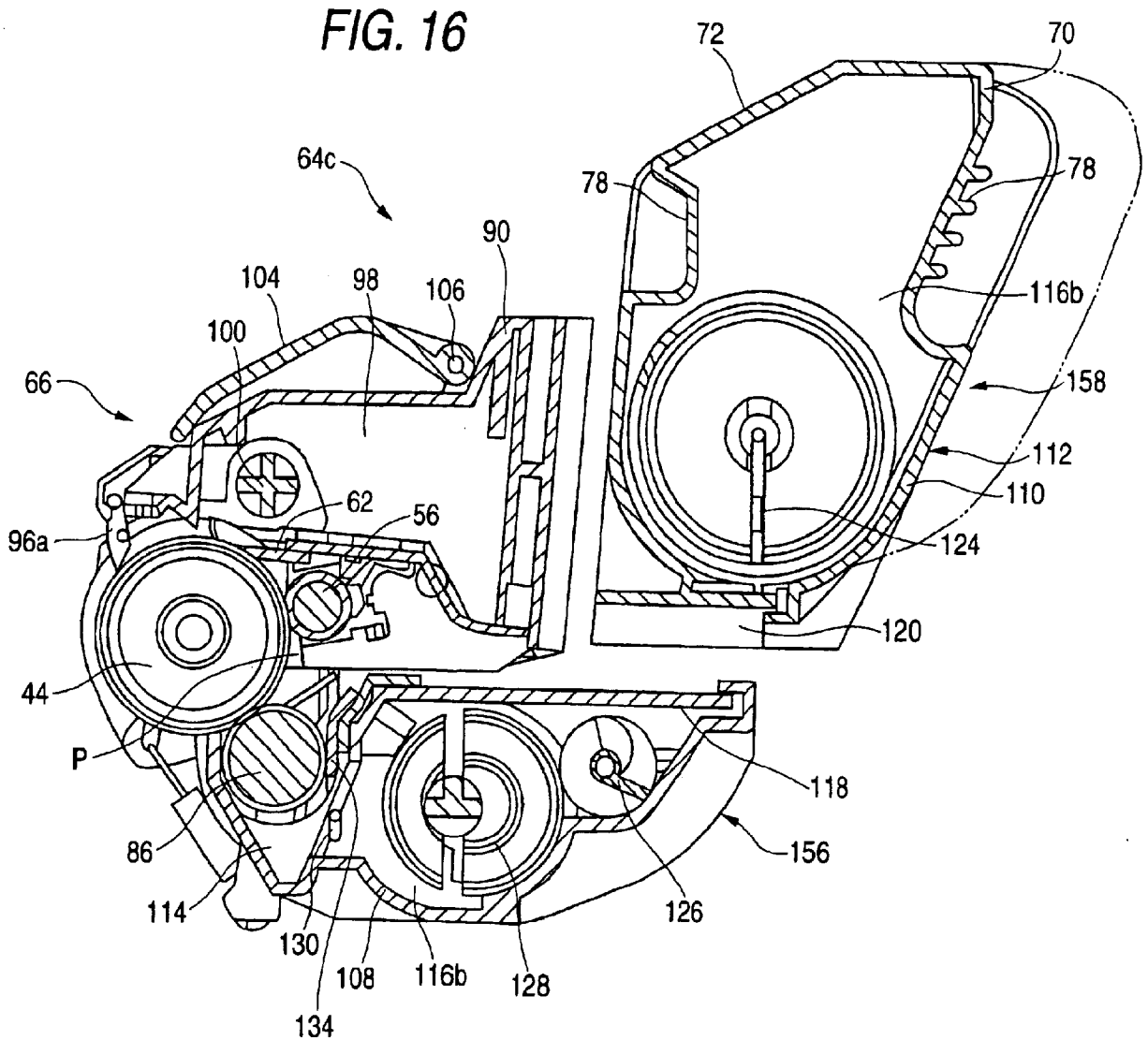
FIG. 16 is a sectional view for indicating the process cartridge according to the third embodiment mode of the present invention, namely such a condition that a third cartridge unit is separated.
Figure 17:
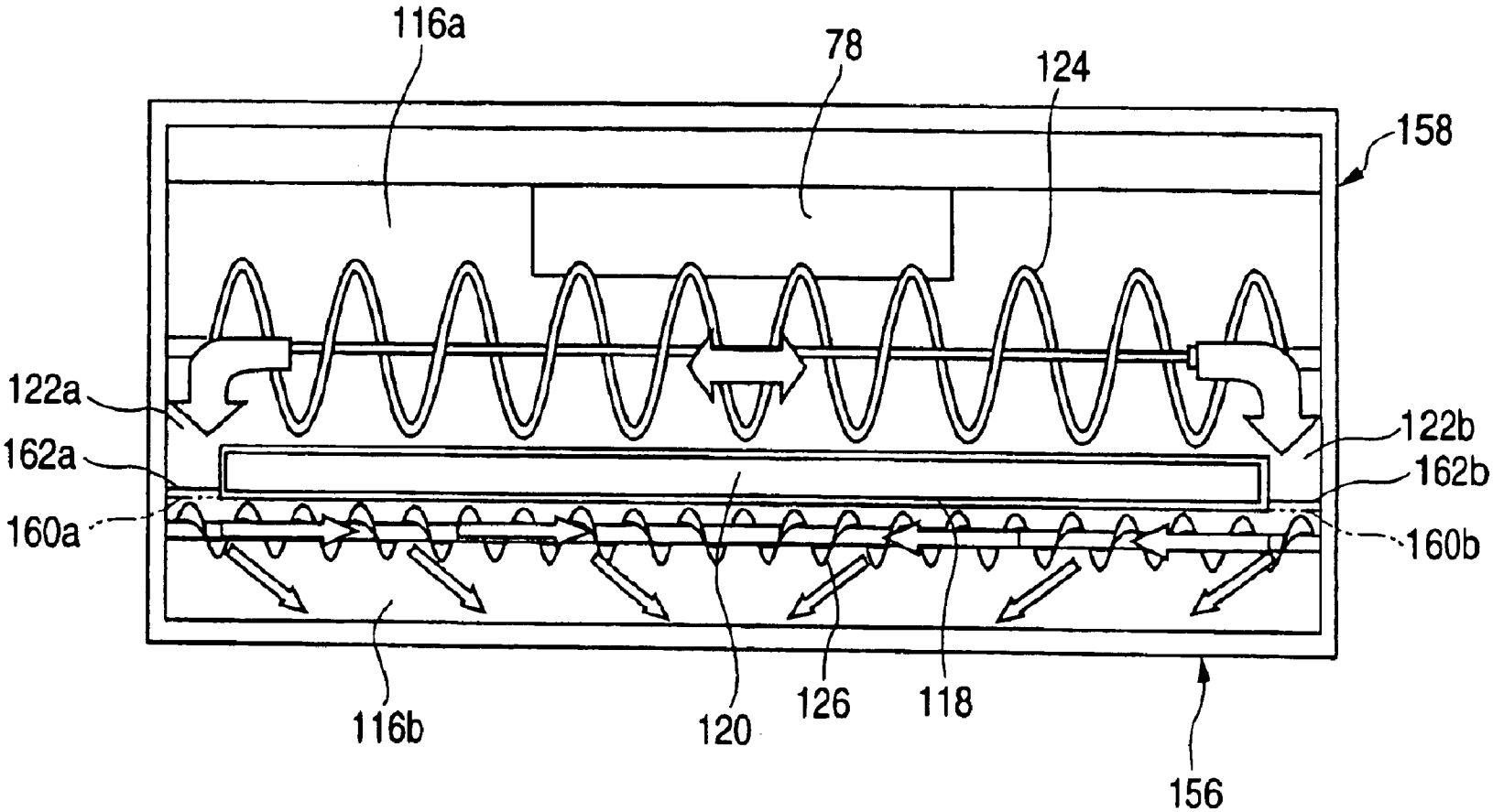
FIG. 17 is a side view for representing a supply path of developer in the process cartridge according to the third embodiment mode of the present invention.

FIG. 15 to FIG. 17 indicate a process cartridge 64*c* according to a third embodiment mode of the present invention. This process cartridge 64*c* of the third embodiment mode has such a different structure that this process cartridge 64*c* is constructed of three cartridge units in contrast to the process cartridge 64*b* of the second embodiment mode which is constituted by two detachable cartridge units. In other words, a developing apparatus portion is separated into both a second cartridge unit 156 and a third cartridge unit 158, which are detachably mounted. The second cartridge unit 156 is arranged by the developing unit 114 and the first developer storage unit 116*a*. The third cartridge unit 158 is arranged by the second developer storage unit 116*b*. The second cartridge unit 156 and the third cartridge unit 158 are separated from each other at, for example, a lower portion of the partition wall 118. Both a communication hole 160*a* and another communication hole 160*b* are formed on both sides of an upper portion of the second cartridge unit 156. There communication holes 160*a* and 160*b* are communicated to the developer paths 122*a* and 122*b*. The third cartridge unit 158 corresponds to an auxiliary cartridge which is mounted in the case that a developer capacity is increased. In such a case that this third cartridge unit 158 is not mounted, the communication holes 160*a* and 160*b* are closed by communication hole sealing members 162*a* and 162*b*. A sort of such a third cartridge unit 158 is not limited to one sort, but may be another sort of third cartridge unit having a larger developer capacity, as indicated by a two-dot/dash line of FIG. 16. As a consequence, three, or more sorts of process cartridges having different developer storage capacities may be manufactured, since various process cartridges containing no third cartridge unit (no auxiliary cartridge) 158, and also third cartridge units 158 having different storage capacities are prepared.

In the embodiment modes, the one-component developing system is employed. The present invention is not limited to this one-component developing system, but may be applied to a two-component developing system. Also, in the above-explained embodiment mode, the developed image is directly transferred from the image carrier to the recording medium. However, the present invention is not limited to this transfer operation, but may be applied to another embodiment in which an intermediate transfer member may be interposed between the image carrier and the recording medium. Furthermore, in the embodiment modes, the black/white image forming apparatus has been described. Apparently, the present invention may be applied to a color image forming apparatus. In this case, for instance, assuming now that four developing apparatus are employed, if a developer storage space of at least one developing apparatus is arranged under the ejection unit, then the dead space problem may be sufficiently solved.

As previously described, in accordance with the present invention, since the developer storage unit can be changed, the developer storage capacity can be easily changed. Also, both the image forming apparatus and the process cartridge can be provided which can be realized in compact sizes.

Also, since the developer storage unit can be changed during the recycling operation, the developer storage capacity can be determined in the flexible manner.

What is claimed is:

1. An image forming apparatus comprising:

an image forming section having an image carrier; and an ejection unit from which a recording medium where an image has been formed by the image forming section is ejected, wherein a first developer storage unit is provided under a horizontal line which is extended from a latent image writing position of the image carrier where a latent image is written along a substantially horizontal direction, a developer-storing space for arranging a second developer storage unit is provided above the horizontal line extended from the latent image writing position of the image carrier and between the horizontal line and the ejection unit, and a developer collecting space is provided for storing developer collected from the image forming section by a cleaning apparatus.

2. An image forming apparatus comprising:

an image forming section having an image carrier; and an ejection unit from which a recording medium where an image has been formed by the image forming section is ejected, wherein a first developer storage unit is provided under a horizontal line which is extended from a latent image writing position of the image carrier where a latent image is written along a substantially horizontal direction, a developer-storing housing unit for forming a second developer storage unit is provided above the horizontal line extended from the latent image writing position of the image carrier and between the horizontal line and the ejection unit, and a developer collecting space is provided for storing developer collected from the image forming section by a cleaning apparatus.

3. An image forming apparatus according to claim 2, wherein in the developer-storing housing unit, a stirring/transporting member hole is formed which holds a stirring/transporting member for stirring/transporting developer stored in the second developer unit.

4. An image forming apparatus according to claim 2, wherein a developer storage capacity of the second developer storage unit is larger than that of the first developer storage unit.

5. An image forming apparatus according to claim 2, wherein the image forming section includes the image carrier, the first developer storage unit, and the second developer storage unit, and is comprised of a process cartridge having a developing unit for developing a latent image of the image carrier so as to produce a visible image.

6. An image forming apparatus according to claim 5, wherein the process cartridge is comprised of storage section for storing information relating to whether or not the second developer storage unit is present.

7. An image forming apparatus according to claim 5 wherein:

the process cartridge is comprised of a first cartridge unit in which the first developer storage unit is provided, and a second cartridge unit in which the second developer storage unit is provided; and the second cartridge unit is detachably provided with respect to the first cartridge unit.

8. An image forming apparatus according to claim 5, wherein the process cartridge is comprised of a first cartridge unit in which the first developer storage unit is provided, a second cartridge unit in which the second developer storage unit is provided, and a third cartridge unit in which the image carrier is provided, and the first cartridge unit, the second cartridge unit, and the third cartridge unit are detachably mounted with respect to the respective cartridge units.

9. An image forming apparatus comprising:

an image forming section having an image carrier; and an ejection unit from which a recording medium where an image has been formed by the image forming section is ejected, wherein the image forming section includes a first developer storage unit provided under a horizontal line which is extended from a latent image writing position of the image carrier where a latent image is written along a substantially horizontal direction, and a second developer storage unit provided above the horizontal line extended from the latent image writing position of the image carrier and between the horizontal line and the ejection unit, and the second developer storage unit is detachably mounted.

10. A process cartridge used in an image forming apparatus equipped with an image forming section having an image carrier, and an ejection unit from which a recording medium where an image has been formed by the image forming section is ejected, wherein the process cartridge includes a first developer storage unit provided under a horizontal line which is extended from a latent image writing position of the image carrier where a latent image is written, a developer-storing space for arranging a second developer storage unit between the horizontal line and the ejection unit is formed above the horizontal line extended from the latent image writing position of the image carrier, and a developer collecting space is provided for storing developer collected from the image forming section by a cleaning apparatus.

11. A process cartridge used in an image forming apparatus equipped with an image forming section having an image carrier, and an ejection unit from which a recording medium where an image has been formed by the image forming section is ejected, wherein the process cartridge includes a first developer storage unit provided under a horizontal line which is extended from a latent image writing position of the image carrier where a latent image is written, a developer-storing housing unit for forming a second developer storage unit, which is provided above the horizontal line extended from the latent image writing position of the image carrier and between the horizontal line and the ejection unit, and a developer collecting space is provided for storing developer collected from the image forming section by a cleaning apparatus.

12. A process cartridge according to claim 11, wherein in the developer-storing housing unit, a stirring/transporting member hole is formed which holds a stirring/transporting member for stirring/transporting developer stored in the second developer storage unit.

13. A process cartridge according to claim 11, wherein a developer storage capacity of the second developer storage unit is larger than that of the first developer storage unit.

14. A process cartridge according to claim 11, wherein the process cartridge is further comprised of storage section for storing information relating to whether or not the second developer storage unit is present.

15. A process cartridge used in an image forming apparatus equipped with an image forming section having an image carrier, and an ejection unit from which a recording medium where an image has been formed by the image forming section is ejected, wherein the process cartridge includes a first developer storage unit provided under a horizontal line which is extended from a latent image writing position of the image carrier where a latent image is written, and wherein a second developer storage unit is detachably mounted which is provided above the horizontal line extended from the latent image writing position of the image carrier and between the horizontal line and the ejection unit, and a developer collecting space is provided for storing developer collected from the image forming section by a cleaning apparatus.

16. A process cartridge comprising:

a first cartridge unit where a first developer storage unit is provided; and a second cartridge unit where a second developer storage unit is provided, wherein the second cartridge unit is detachably mounted with respect to the first cartridge unit.

17. An auxiliary cartridge comprising:

a developer storage unit which can be coupled to a first developer storage unit wherein the first developer storage unit is provided in a process cartridge having a first cartridge unit, and wherein the auxiliary cartridge is detachably mounted on the first cartridge unit.

18. A process cartridge comprising:

a first cartridge unit where an image carrier is provided;

a second cartridge unit where a first developer storage unit is provided; and a third cartridge unit where a second developer storage unit is provided, wherein the first cartridge unit, the second cartridge unit, and the third cartridge unit are detachably mounted with respect to each other.

19. A method of recycling a process cartridge having a first developer storage unit, and a developer-storing housing unit for forming a second developer storage unit, wherein developer is filled into the first developer storage unit under such a condition that at least a stirring/transporting member is dismounted from the developer-storing housing unit, a used cartridge is collected, at least a stirring/transporting member is mounted on the developer-storing housing unit to constitute the second developer storage unit, and developer is filled into both the first developer storage unit and the second developer storage unit.

20. A method of processing a process cartridge having a first developer storage unit, and a developer-storing housing unit for forming a second developer storage unit, wherein a used cartridge is collected under such a condition that at least a stirring/transporting member is dismounted from the developer-storing housing unit, and at least the stirring/transporting member is mounted on the used cartridge which has been collected.

* * * * *